US006511304B1

(12) United States Patent
Veen

(10) Patent No.: US 6,511,304 B1
(45) Date of Patent: Jan. 28, 2003

(54) RADIAL PLUNGER MACHINE

(75) Inventor: Daniël van't Veen, Borne (NL)

(73) Assignee: Actuant Corporation, Glendale, WI (US)

( * ) Notice: Subject to any disclaimer, the term of this patent is extended or adjusted under 35 U.S.C. 154(b) by 0 days.

(21) Appl. No.: 09/990,666

(22) Filed: Nov. 21, 2001

Related U.S. Application Data

(63) Continuation of application No. PCT/NL00/00360, filed on May 25, 2000.

(30) Foreign Application Priority Data

May 25, 1999 (NL) ..... 1012151

(51) Int. Cl.[7] ..... F09B 19/02
(52) U.S. Cl. ..... 417/462; 417/DIG. 1
(58) Field of Search ..... 417/462, DIG. 1

(56) References Cited

U.S. PATENT DOCUMENTS 3,935,794 A 2/1976 Rumsey ..... 91/488
4,030,405 A 6/1977 Aldinger et al. ..... 92/58
4,033,237 A 7/1977 Rutz ..... 91/488
4,505,652 A * 3/1985 Burgdorf et al. ..... 417/462
4,555,223 A 11/1985 Budecker et al. ..... 417/462
5,829,411 A 11/1998 Cooper et al. ..... 123/450

OTHER PUBLICATIONS

International Search Report, Form PCT/ISA/210, as issued by European Patent Office in Connection with PCT Appl. No. PCT/NL00/00360.

Kent's Mechanical Engineer's Handbook, Power vol., Twelfth Edition, pp. 3–10, J. Kenneth Salisbury Editor, John Wiley Sons, Inc., copyright 1976.*

Introduction to Materials Science For Engineers, pp. 258–261, James F, Shackelford, Macmillan Publishing Company, copyright 1985.*

* cited by examiner

*Primary Examiner*—Charles G. Freay
(74) *Attorney, Agent, or Firm*—Quarles & Brady LLP

(57) ABSTRACT

A radial plunger machine is disclosed. The radial plunger machine includes a pintle and a rotor which is rotatable about said pintle, at least one radial cylinder bore being provided in the rotor, a plunger being reciprocably arranged in said cylinder bore, and the pintle being provided with an inlet duct and an outlet duct for supplying and discharging hydraulic fluid to and from the cylinder bore, respectively. The pintle is made from austenitic stainless steel and has a higher coefficient of linear thermal expansion than the material of the rotor.

6 Claims, 3 Drawing Sheets

1
2
3
5
6
7
8
9
10
11
12
15
16
17
18
19
21

6
9
10
11
12
15
18
20

RADIAL PLUNGER MACHINE

CROSS-REFERENCE TO RELATED APPLICATIONS

This is a continuation application of PCT/NL00/00360 filed May 25, 2000, which PCT application claims the priority of NL application number 1012151 filed May 25, 1999.

FIELD OF THE INVENTION

The present invention relates to a radial plunger pump or radial plunger motor, comprising a rotor which can rotate about a stationary pintle, at least one radial cylinder bore being provided in the rotor, a plunger being arranged reciprocable in said bore, and the pintle being provided with an inlet duct and an outlet duct for supplying and discharging liquid to and from the cylinder bore.

BACKGROUND OF THE INVENTION

In one frequently encountered design of a radial plunger pump, the rotor is made from bronze and the pintle is made from hardened free-cutting steel. When the pump is in operation, the pintle is subject to a considerable load which is directed substantially transversely to the pintle and emanates from the hydraulic pressure. Furthermore, the rotor usually rotates at a high speed about the pintle, so that there is a risk of considerable wear and, for this reason, in known plunger pumps it is chosen to combine a pintle made from hardened free-cutting steel and a rotor made from bronze.

As is known, in radial plunger pumps of this type there is a gap between the rotor and the pintle. Pressurized liquid leaks through this gap, a phenomenon which is known as leakage loss. In the known radial plunger pumps, it is usually the case that this leakage loss increases when the temperature rises, and consequently the efficiency of the pump falls. Also, bronze has a relatively low modulus of elasticity, so that the rotor is deformed under the influence of the hydraulic pressure in the gap between the pintle and the rotor, with the result that this gap becomes larger.

It is known to reduce the leakage loss from the above-mentioned radial plunger pumps by making the rotor mainly from steel with an inner bronze bush which fits around the pintle. However, this is an expensive solution and does not give satisfactory results.

OBJECT OF THE INVENTION

The object of the present invention is to eliminate the above drawback and to provide a radial plunger pump or radial plunger motor with a high level of efficiency.

SUMMARY OF THE INVENTION

The invention relates to a radial plunger machine comprising a pintle and a rotor which is rotatable about said pintle, at least one radial cylinder bore being provided in the rotor, a plunger being reciprocable arranged in said cylinder bore, and the pintle being provided with an inlet duct and an outlet duct for supplying and discharging liquid to and from the cylinder bore, respectively. According to the invention the pintle is made from a material with a higher coefficient of linear thermal expansion than the material of the rotor.

In the radial plunger machine according to the invention it is ensured that, when the temperature rises, the gap between the pintle and the rotor becomes smaller. This is highly advantageous since as a result it is possible to entirely or largely compensate for the fact that, when the temperature rises, the viscosity of the liquid falls, and can therefore pass through the gap more easily.

In a preferred embodiment of the radial plunger the pintle is made from stainless steel and has a higher coefficient of linear thermal expansion than the material of the rotor. Selecting stainless steel for the pintle in combination with a suitable material for the rotor, preferably free-cutting steel, has the considerable advantage that the coefficient of thermal expansion of stainless steel is high, in particular higher than most other grades of steel, such as in particular free-cutting steel. Consequently, in this case too it is possible to make the gap between the pintle and the rotor become smaller as the temperature rises.

In a particularly advantageous embodiment of the plunger pump or motor, the pintle is made from austenitic stainless steel. This specific grade of steel is suitable for absorbing the loads which act on the pintle over a prolonged period and, in particular, has an especially high coefficient of linear thermal expansion. In an advantageous embodiment thereof, the pintle made from austenitic stainless steel is subjected to a surface hardening treatment, which is of benefit in particular to the wear resistance of the pintle.

The invention also relates to a radial plunger machine comprising a rotor which is rotatable about a pintle, at least one radial cylinder bore being provided in the rotor, a plunger being reciprocable arranged in said bore, and the pintle being provided with an inlet duct and an outlet duct for supplying and discharging liquid to and from the cylinder bore, wherein the pintle is made from stainless steel.

It will be clear that the inventive idea can be applied to a radial plunjer pump and to a radial plunger machine which is used as a motor and which is supplied with pressurized liquid.

BRIEF DESCRIPTION OF THE DRAWINGS

The present invention will be explained in more detail below with reference to the drawing, in which.

DETAILED DESCRIPTION OF PREFERRED EMBODIMENT

Figure 1:
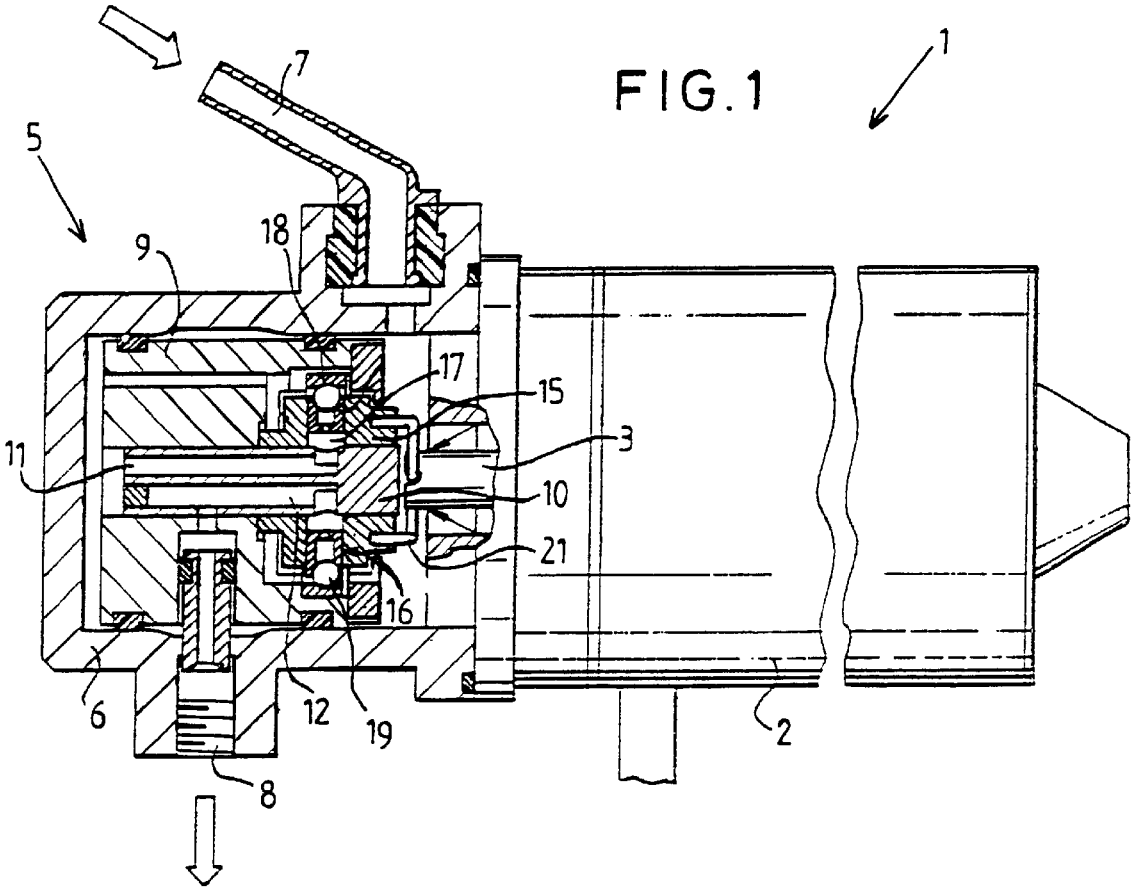
FIG. 1 shows a side view, partially in cross section, through an exemplary embodiment of a pump unit with a radial plunger pump according to the invention.
Figure 2:
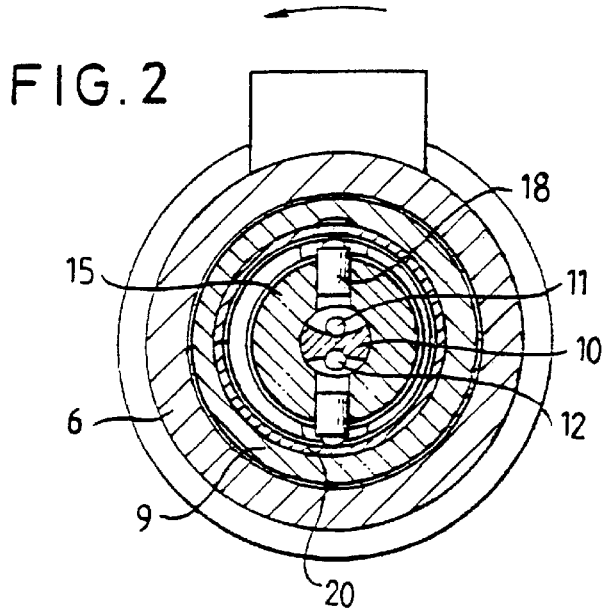
FIG. 2 shows a cross section through the pump shown in FIG. 1.

FIGS. 1 and 2 show a radial plunger pump unit 1 which is intended to be used in a hydraulic system, which plunger pump unit 1 has a structure which is known per se.

The plunger pump unit 1 comprises an electric motor 2 with a rotatable output shaft 3. Furthermore, the plunger pump unit 1 comprises a radial plunger pump 5 which can be driven by the electric motor 2.

The plunger pump 5 has a housing 6 with a suction port 7 for sucking in hydraulic fluid and a delivery port 8 for delivering pressurized hydraulic fluid. The hydraulic fluid is preferably hydraulic oil.

The housing 6 has a cavity in which a stator part 9 is accommodated in such a manner that it cannot rotate. The stator part 9 comprises a pintle 10 which is fixed in a stationary manner, in this example using a press fit. The pintle 10 is provided with an inlet duct 11 and with an outlet duct 12 for hydraulic fluid. These ducts 11, 12 extend through the pintle 10 and are respectively in communication with the ports 7 and 8 in the housing 6 of the pump 5.

A rotor 15 is arranged rotatably about the projecting section of the pintle 10. The rotor 15 has a rotor body in which there is a bore for the pintle 10 which is such that there is a narrow gap between the rotor 15 and that part of the pintle 10 which fits into it. In this example, the rotor 15 is provided with two radial bores 16, 17 which lie diametrically opposite one another and in each of which a plunger 18, 19 can slide in a reciprocating fashion. Obviously, it is possible for more bores and plungers to be incorporated in the body of the rotor 15. In this example, the plungers 18, 19 each have a ball at their radially outer end, by means of which the plungers 18, 19 bear against a running surface 20 of the stator part 9. The running surface 20 is in this case circular and arranged eccentrically with respect to the pintle 10.

The shaft 3 of the motor 2 is coupled to the body of the rotor 15 via a coupling 21.

The ducts 11, 12 each have an opening in the circumferential surface of the pintle 10, in the region where the bores 16, 17 in the rotor 15 pass by. Therefore the ducts 11, 12 are in communication with the said cylinder bores in the rotor 15 according to the position of the rotor 15.

When a plunger pump 5 of this nature is in operation, fluid is sucked into a bore in the rotor 15 via the inlet duct 11, is pressurized by the inward movement of the associated plunger and is delivered from this bore via the outlet duct 12. In pumps of this type, the pressure of the hydraulic fluid may be several tens of bar, even hundreds of bar.

Owing to the need for the rotor 15 to be able to rotate about the pintle 10, the rotor 15 cannot be clamped tightly around the said pintle 10, and it is desirable for there to be a small gap between these components. However, pressurized fluid can then leak out via this gap, in particular to the sides of the rotor, which reduces the efficiency of the pump 5.

The invention proposes that, by suitably selecting the materials from which the pintle 10 and the rotor 15 are made, the said gap becomes smaller when the temperature rises. This can be achieved by making the pintle 10 from a material with a higher coefficient of linear thermal expansion than the material of the rotor 15.

The importance of this measure can be explained in simple terms with reference to an example. Assume that the plunger pump unit 1 forms part of a vehicle, for example as a component of the drive for the covering cap in a cabriolet vehicle or as part of the power steering, brake system or cab-tilting system, pumping hydraulic oil. At a low temperature, for example when the vehicle is started up during the winter, the gap will initially be relatively large, after which the plunger pump heats up to its operating temperature, and, in the process, the gap becomes smaller. This effect is highly advantageous since, at the low temperature, the oil is relatively thick and because of the relatively large gap the start-up resistance of the pump is limited, while at the same time a good lubrication is also ensured. When the temperature rises, however, the oil becomes more fluid and can then leak out through the gap more easily in relative terms. However, since the gap now becomes smaller, the leakage loss remains limited. Compared to known plunger pumps, it is apparent that this leakage loss increases to a much lesser extent when the temperature rises.

When selecting the materials for the rotor 15 and the pintle 10, the loads to which these components are subjected and the wear performance must be taken into account.

In a preferred embodiment of the invention, the pintle 10 is made from austenitic stainless steel, and the rotor 15 is made from free-cutting steel. Preferably, the pintle 10, in particular that part around which the rotor 15 rotates, is subjected to a hardening treatment, advantageously a surface hardening treatment.

Stainless steel generally has a chromium content of 12% or higher, and in the case of austenitic stainless steel the chromium content is generally 16% or higher. The coefficient of linear thermal expansion of austenitic stainless steel is considerable, usually between 16 and 18 $10^{-6}$/K.

Free-cutting steel has the advantage of being easy to process, for example by machining, and furthermore the coefficient of linear thermal expansion is usually between 14.5 and 15.5 $10^{-6}$/K. This combination of materials for the pintle and the rotor therefore provides the effect described above. The standard term free-cutting steel includes, inter alia, steel grades which are known by the German name Werkstoff 10711, 10718, 10721 and 10726.

Figure 3:
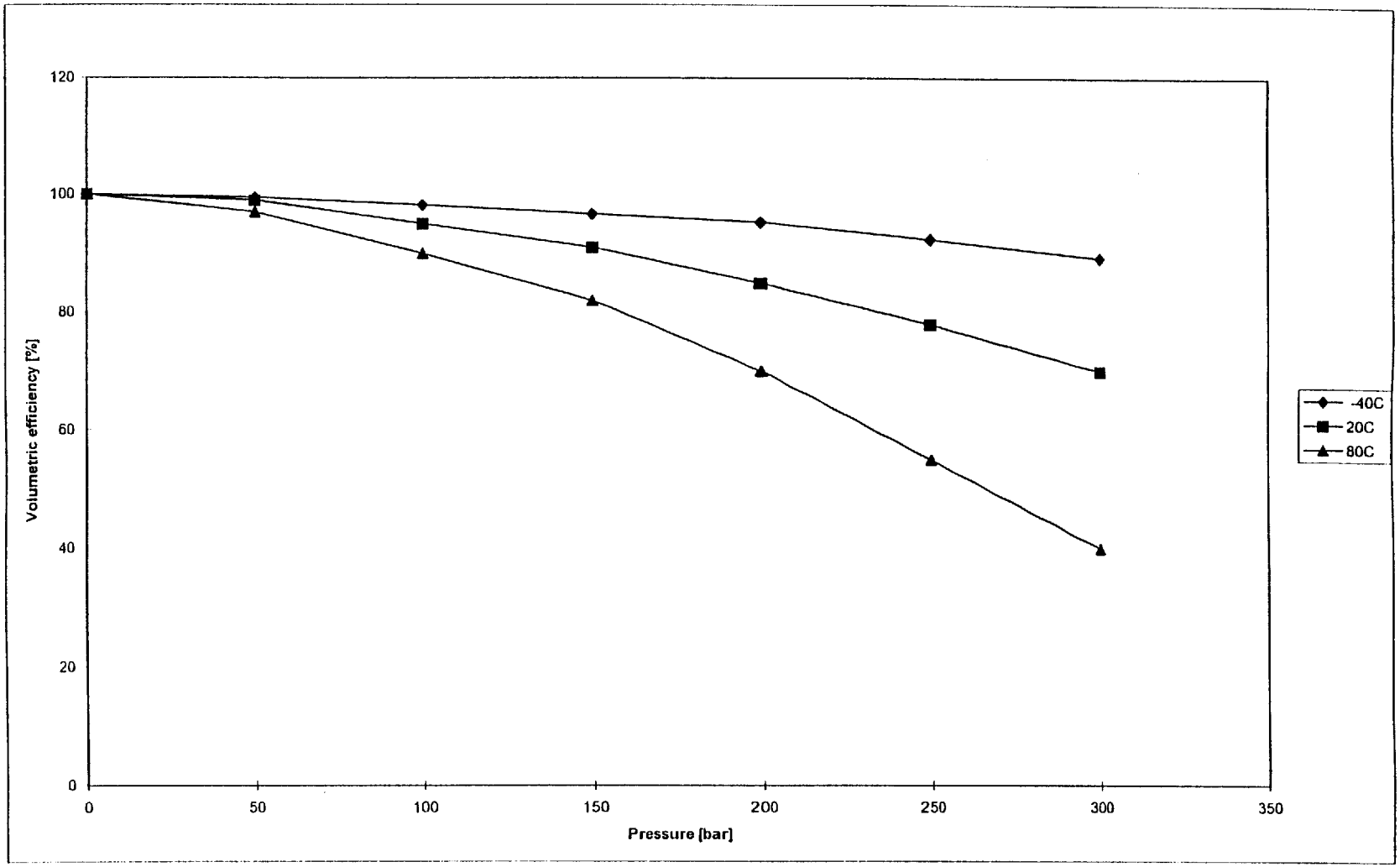
FIG. 3 shows a graph plotting the volumetric efficiency of a known plunger pump with a pintle made from hardened free-cutting steel and a rotor made from bronze.
Figure 4:
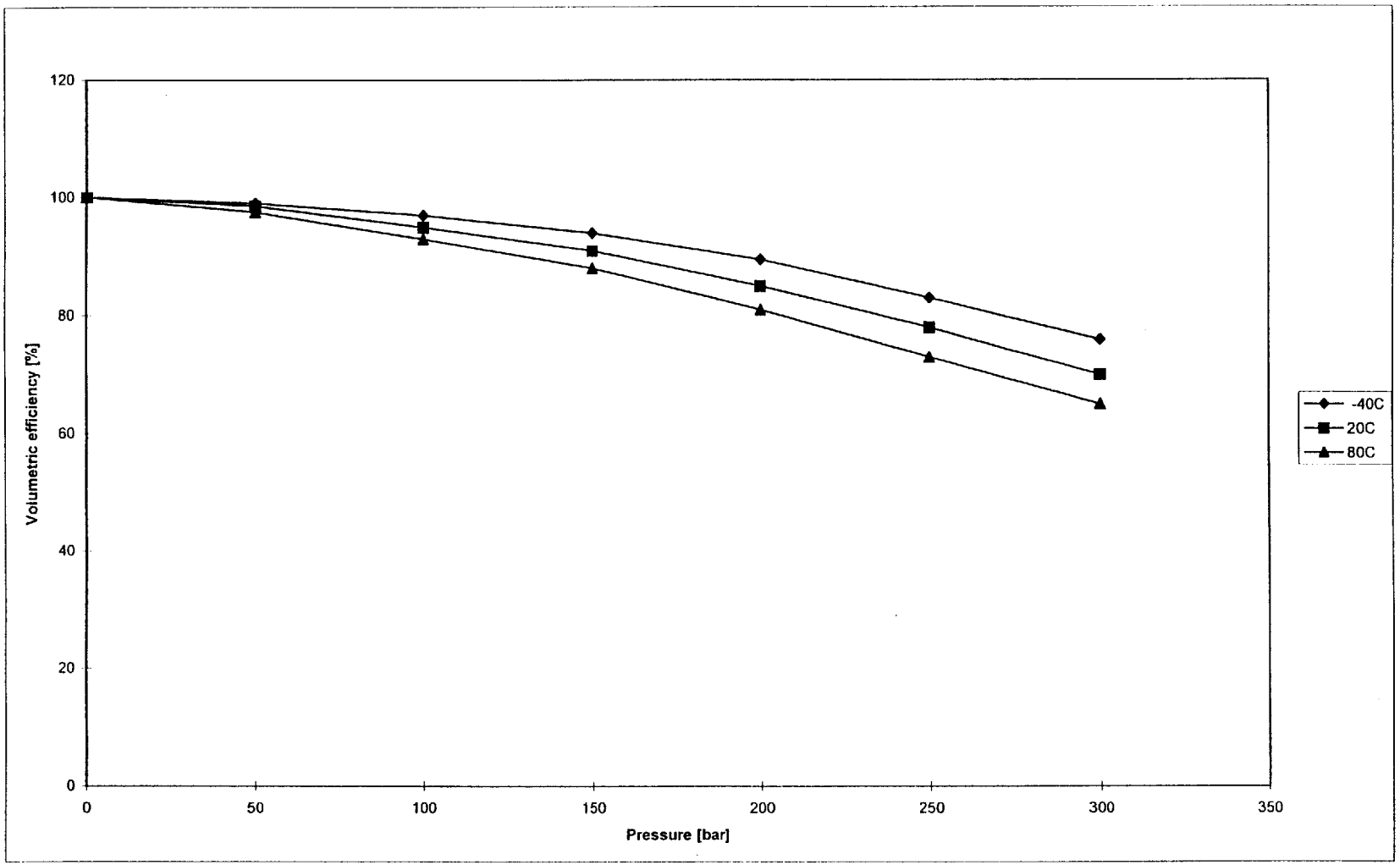
FIG. 4 shows a graph plotting the volumetric efficiency of a plunger pump according to the invention with a pintle made from austenitic stainless steel which has been subjected to a surface hardening treatment and a rotor made from steel.

The particular advantage of the measures according to the invention can be seen clearly from the graphs given in FIGS. 3 and 4.

FIG. 3 plots the volumetric efficiency which is measured in a known radial plunger pump with a pintle made from hardened free-cutting steel and a rotor made from bronze. The efficiency is measured at different operating pressures, with a maximum pressure of 300 bar. Furthermore, measurements are carried out at three significantly different temperatures, namely −40° C. and 80° C. The lowest temperature is, for example, representative of starting the pump in a cold environment. In the graphs shown in FIG. 3, it can be seen clearly that, when the temperature rises, the leakage loss increases considerably.

In FIG. 4, the graphs also illustrate the volumetric efficiency, but in this case, of a plunger pump according to a preferred embodiment of the invention as explained above, with a pintle made from hardened austenitic stainless steel and a rotor made from free-cutting steel. Compared to FIG. 3, it can be seen clearly that the leakage loss when the temperature rises increases to a much lesser extent than in the known plunger pump.

In a further advantageous embodiment, the plungers 18, 19 are also made from steel, so that their coefficient of expansion is approximately equal to that of the steel rotor 15. This also limits the leakage losses along the plungers.

What is claimed is:

1. A radial plunger machine comprising a pintle and a rotor which is rotatable about said pintle, at least one radial cylinder bore being provided in the rotor, a plunger being reciprocably arranged in said cylinder bore, and the pintle being provided with an inlet duct and an outlet duct for supplying and discharging hydraulic fluid to and from the cylinder bore, respectively, wherein the pintle is made from stainless steel and has a higher coefficient of linear thermal expansion than the material of the rotor, and wherein the pintle is made from austenitic stainless steel.

2. A radial plunger machine according to claim 1, in which the pintle is subjected to a hardening treatment.

3. A radial plunger machine according to claim 1, in which the pintle is subjected to a surface hardening treatment.

4. A radial plunger machine according to claim 1, in which the rotor is made from steel.

5. A radial plunger machine according to claim 1, in which the rotor is made from free-cutting steel.

6. A radial plunger machine according to claim 1, in which the plunger is made from steel.

* * * * *